US008138916B1

(12) United States Patent
Gonzalez

(10) Patent No.: US 8,138,916 B1
(45) Date of Patent: Mar. 20, 2012

(54) COUNTERFEIT DETECTION SYSTEM AND METHOD OF UTILIZING SAME

(76) Inventor: Carlos Andres Gonzalez, Miami, FL (US)

( * ) Notice: Subject to any disclaimer, the term of this patent is extended or adjusted under 35 U.S.C. 154(b) by 547 days.

(21) Appl. No.: 12/477,997

(22) Filed: Jun. 4, 2009

(51) Int. Cl.
*G08B 21/00* (2006.01)

(52) U.S. Cl. ..... 340/540; 235/379

(58) Field of Classification Search ..... 340/10.1, 340/572.1, 573.1
See application file for complete search history.

(56) References Cited

U.S. PATENT DOCUMENTS 5,430,664 A 7/1995 Cargill et al.
6,131,718 A 10/2000 Witschorik
6,363,363 B1 3/2002 Haller et al.
6,550,671 B1 4/2003 Brown et al.
6,868,408 B1 3/2005 Rosen
2003/0185244 A1 10/2003 Wu et al.
2004/0232218 A1 * 11/2004 Graham ..... 235/379
2005/0056693 A1 3/2005 Yokoi et al.
2006/0085843 A1 4/2006 Onischuk
2006/0180661 A1 8/2006 Grant et al.
2007/0056041 A1 3/2007 Goodman

* cited by examiner

*Primary Examiner* — Shirley Lu
(74) *Attorney, Agent, or Firm* — Albert Bordas, P.A.

(57) ABSTRACT

A counterfeit detection system and method of utilizing same, comprising a Point of Service system having at least one Point of Service station and a respective Currency-Scanning Device, and at least one communication module; a hub/switch; a surveillance system; a local server; and a database. The counterfeit detection system and method of utilizing same also comprises counterfeit detection means, and software updating means.

5 Claims, 4 Drawing Sheets

COUNTERFEIT DETECTION SYSTEM AND METHOD OF UTILIZING SAME

BACKGROUND OF THE INVENTION

1. Field of the Invention

The present invention relates to counterfeit detection systems, and more particularly, to systems having counterfeit detectors capable of communicating via networks.

2. Description of the Related Art

Presently, currency verification devices, defined as Currency Scanning Devices, are stand-alone models. Currency's data is stored locally into a Currency Scanning Device. However, the Currency Scanning Device does not have any communication hardware or software media, making impossible its integration with other resources for better functional performance. Thus, not being able to increase its functional capabilities. Additional limitations include that every time a new denomination is issued or the Federal Reserve carries out new design change, qualified personnel must update new data into each Currency Scanning Device, one at a time.

Applicant believes that one of the closest references corresponds to U.S. Patent Application Publication No. 2007/0056041, published on Mar. 8, 2007 to Goodman for a method and device for product and document authentication. However, it differs from the present invention because Goodman teaches counterfeit articles that are distinguished from genuine articles by a combination of a party-specific code and a product authentication code of the article. After authenticating a genuine article, a replacement authentication code is generated based on the original authentication code and party-specific code. Documents and currencies can be authenticated independently of any party-specific code by an addition to or alteration of their authentication code with each authentication event.

Applicant believes that another reference corresponds to U.S. Patent Application Publication No. 2006/0180661, published on Aug. 17, 2006 to Grant, et al. for a method and system for deterring product counterfeiting, diversion and piracy. However, it differs from the present invention because Grant et al. teaches a method and system for authenticating goods and thereby detecting and deterring counterfeits. According to one aspect, a client utilizes data received from a host to generate a plurality of security codes and to direct a printing device to print the plurality of security codes on a plurality of products, without retaining the plurality of security codes after the printing device has printed the plurality of security codes on the plurality of products. After the security codes have been printed, a person can communicate the security code to the host, which can verify its authenticity.

Applicant believes that another reference corresponds to U.S. Patent Application Publication No. 2006/0085843, published on Apr. 20, 2006 to Onischuk for a computerized authentication system. However, it differs from the present invention because Onichuk teaches a computer system used to track unique identifiers of items to reduce losses due to fraud. A unique identifier (RSID) is assigned to each item (such as, but not limited to: money order, paper currency). The RSID is used to authenticate if the item is valid for use. As counterfeit RSIDs are detected, they are added to a computer database, enabling comparison of an RSID to all of the already known and counterfeit items RSID's. The RSID may further be used to identify the location of the item. By identifying the location where the request for authentication occurred, any subsequent request for the same RSID is assessed by people or computers executing tracking and assessment software programs. The RSID requestor is compared to other recent requests for the same RSID. If the time and physical distance between locations are reasonable as per computer program models and data, then no action is taken. However, if a RSID is reported at nearly the same time in distant places, or outside a reasonable transportation time limit for the last known reported location of the item, then an alert message is sent to the requester indicating the item may be counterfeit, so that the requestor more closely inspects the item.

Applicant believes that another reference corresponds to U.S. Patent Application Publication No. 2005/0056693, published on Mar. 17, 2005 to Yokoi, et al. for a bill handling machine and controlling method for a bill-handling machine. However, it differs from the present invention because Yokoi, et al. teaches a bill handling machine including a bill discriminator, which discriminates between genuine and counterfeit bills; a cash box including first and second bill storing boxes which store bills to be recycled, the first bill storing box for storing bills of first type, the second bill storing box for storing bills of second type; a non-genuine bill storing box, which is provided outside the cash box and stores a bill that is suspected or determined to be non-genuine by the bill discriminator; a temporary stocker which temporarily stores bills prior to storing the bills in the first and second bill storing boxes or the non-genuine bill storing box; and a transport component configured to transport the bills to the temporary stocker, first and second bill storing boxes, and non-genuine bill storing box, wherein an entry to the non-genuine bill storing box is provided at a section of the transport path that is between the bill discriminator and temporary stocker.

Applicant believes that another reference corresponds to U.S. Patent Application Publication No. 2003/0185244, published on Oct. 2, 2003 to Wu, et al. for detecting a counterfeit access point in a wireless local area network. However, it differs from the present invention because Wu, et al. teaches beacon frames that are transmitted over a wireless local area network by one or more access points, in a wireless local area network. The beacon frames are received at a detector in the wireless local area network. The received beacon frames are analyzed at the detector to detect a counterfeit access point in the wireless local area network.

Applicant believes that another reference corresponds to U.S. Pat. No. 6,868,408 issued to Rosen on Mar. 15, 2005 for a security system and method applicable to an electronic monetary system. However, it differs from the present invention because Rosen teaches an electronic-monetary system having (1) banks or financial institutions that are coupled to a money generator device for generating and issuing to subscribing customers electronic money including electronic currency backed by demand deposits and electronic credit authorizations; (2) correspondent banks that accept and distribute the electronic money; (3) a plurality of transaction devices that are used by subscribers for storing electronic money, for performing money transactions with the on-line systems of the participating banks or for exchanging electronic money with other like transaction devices in off-line transactions; (4) teller devices, associated with the issuing and correspondent banks, for process handling and interfacing the transaction devices to the issuing and correspondent banks, and for interfacing between the issuing and correspondent banks themselves; (5) a clearing bank for balancing the electronic money accounts of the different issuing banks; (6) a data communications network for providing communications services to all components of the system; and (7) a security arrangement for maintaining the integrity of the system, and for detecting counterfeiting and tampering within the system. This system includes a customer service module, which handles lost money claims and links accounts to money modules for providing bank access.

Applicant believes that another reference corresponds to U.S. Pat. No. 6,550,671 issued to Brown, et al. on Apr. 22, 2003 for a cash register and method of accounting for cash transactions. However, it differs from the present invention because Brown, et al. teaches a method of obtaining, recording and using a denomination and serial number of bills received into cash registers from purchasers, and using computer automation to dispense other bills from the cash registers to make change. Enhanced accounting, security and efficiency for cash transactions is provided by electronically associating bills with information describing the purchases and, optionally, transmitting electronically this information to the purchaser. Optical character recognition is used to identify the denomination and serial number of each bill. Optionally, a cashier may enter a duress code into the register to initiate a silent alarm signal, identify the serial numbers of each bill dispensed under duress, or mark an invisible ink onto each bill dispensed under duress. The method also enables determining whether each bill received is counterfeit or stolen.

Applicant believes that another reference corresponds to U.S. Pat. No. 6,363,363 issued to Haller et al. on Mar. 26, 2002 for a system, method and article of manufacture for managing transactions in a high availability system. However, it differs from the present invention because Haller et al. teach architecture allowing a server to communicate bidirectionally with a gateway over a first communication link, over which service requests are initiated by the server. In response to a transaction received from a host legacy system at the gateway, the gateway parses one or more transaction response values from the host message, maps the one or more transaction response values to a canonical response code, and stores the canonical response code in a transaction log. Communication networks that employ transactions between applications must effectively manage transactions that flow over the network. In addition, networking systems must also detect counterfeit transactions, especially, when the networking systems are utilized for financial transactions. An active, on-line database is utilized as a transaction log to track original requests, valid retries and detects fraudulent transactions. The transaction log serves as a memory cache where the received host response is returned to a valid retry transaction should the original response fail to reach a server because of a communications problem.

Applicant believes that another reference corresponds to U.S. Pat. No. 6,131,718 issued to Witschorik on Oct. 17, 2000 for a system and method for the detection of counterfeit currency. However, it differs from the present invention because Witschorik teaches a system and method for detecting counterfeit currency, wherein a currency bill encoded with security data is scanned by a currency scanning terminal placed at a currency exchange location such as a store or a bank. The security data can include the currency bill's serial number and a corresponding code number, and is preferably magnetically encoded on a magnetic medium affixed to or embedded in the bill. The currency scanning terminal reads the security data and transmits it via a communications link to a programmable security computer. The security computer responds to receipt of the security data by comparing the transmitted security data with previously stored security data and generating a comparison result. If the comparison result is true, the security computer calculates an updated security code, stores the updated security code in the data store, and transmits the updated security code to the currency scanning terminal. The currency scanning terminal then writes the updated security data to the currency bill and generates a validation message. If the comparison result is false, the security computer invalidates the currency bill in the data store and transmits a rejection code to the currency scanning terminal. The currency scanning terminal then writes the rejection code to the currency bill and generates a rejection message. The currency bill must have valid security data stored in the data store and the security data is updated each time the currency bill is exchanged.

Applicant believes that another reference corresponds to U.S. Pat. No. 5,430,664 issued to Cargill, et al. on Jul. 4, 1995 for a document counting and batching apparatus with counterfeit detection. However, it differs from the present invention because Cargill, et al. teaches an apparatus for counting and verifying documents with a digital control network. The digital control network coordinates the operations of counting and verifying documents. A transport mechanism moves documents along a guide path through the apparatus. Sensors are located along the guide path for determining optical and magnetic characteristics of the documents and producing signals relative thereto. The measured signals are sampled and digitized by an analog-to-digital converter under the control of a microprocessor. Multiple samples of the sensor signals are accumulated within memory as each document passes adjacent to the sensors. The accumulated values are compared with reference values in order to verify each document, which passes adjacent to the sensors. Documents are counted after verification. Individual piece counts and monetary values of such piece counts are provided and counterfeit documents, such as passed for United States currency, can be detected.

Other patents describing the closest subject matter provide for a number of more or less complicated features that fail to solve the problem in an efficient and economical way. None of these patents suggest the novel features of the present invention.

SUMMARY OF THE INVENTION

The counterfeit detection system and method of utilizing same comprises a new method and process for supporting and improving scanning device performances, as well as, efficiently handling banknote counterfeit attempts. Furthermore, the counterfeit detection system and method of utilizing same uses new generation intelligent Currency Scanning Devices with innovative internal firmware and a new advanced communication module as interface, which allows integration with other systems and resources located on-site or remotely.

The counterfeit detection system and method of utilizing same overcomes the fact that existing technologies require that software within present Currency Scanning Devices need to be upgraded individually in case any new bill denomination is issued or if any new change is performed on the banknote outlook design as well as its security features, whereby upgrading procedures must be carried out only by qualified personnel.

The counterfeit detection system and method of utilizing same further overcomes the fact that in the event of suspicious or counterfeit banknotes, present Currency Scanning Devices are not able to notify this fact to security systems or databases, or notify security personnel in cases were required.

The counterfeit detection system and method of utilizing same further overcomes the fact that in the case a counterfeit banknote is detected, there is not an electronic record of this event in order to make a timeline database, which could be used for investigation purposes.

More specifically, the present invention is a counterfeit detection system and method of utilizing same, comprising a Point of Service system having at least one Point of Service station and a respective Currency-Scanning Device, and at least one communication module; a hub/switch; a local server; a database; and counterfeit detection means. The present invention also comprises software updating means.

Currency data includes specific infrared, magnetic, and/or ultraviolet security features that characterize a unique new currency denomination. The at least one communication module serves as an interface for the respective Currency-Scanning Device.

In the preferred embodiment, the respective Currency-Scanning Device comprises two RJ-45 jacks where a network cable is connected. Using a pass through link, the respective Currency-Scanning Device serves as a bridge between the hub/switch and the at least one Point of Service station, and the at least one communication module is used to interconnect the respective Currency-Scanning Device in a stand-alone selling facility. The at least one communication module is an intelligent device comprising an interface for the respective Currency-Scanning Device through a RS232 serial port having nine poles. The RS232 serial port is defined as Recommended Standard 232 for serial binary data signals connecting between Data Terminal Equipment and Data Circuit-terminating Equipment or a USB interface type A plug defined as Universal Serial Bus, which is a serial bus standard to connect devices to a host computer. The at least one communication module also comprises two RJ-45 jacks that allow it to be connected to a DSL line of the at least one Point of Service station.

The at least one Point of Service station is connected to a cash register machine, card readers, and/or barcode readers. The at least one communication module also comprises two light-emitting diodes on a front panel for status notification. One of the two light-emitting diodes is red to indicate the at least one communication module is powered on, and a second of the two light-emitting diodes is green to indicate an active connection between the at least one communication module and the hub/switch. The at least one communication module also comprises a DB-9 female connector, which generates an audible alarm signal in one of its pins when a counterfeit bill is detected. In the event that a surveillance system is used, a DB-9 female connector integrates the respective Currency-Scanning Device with the surveillance system, thus allowing recording of an event as well as notifying security personnel if desired. The at least one communication module has a unique identification number to identify a location of a fake paper currency and where the fake paper currency was detected, thus enabling a record of date, location, and specific currency data obtained by each respective Currency-Scanning Device, and further comprising at least one DLS router having access through the Internet or world-wide-web to enable the hub/switch to send information to the local server when configured to operate at multiple selling facilities.

It is therefore one of the main objects of the present invention to provide a counterfeit detection system and method of utilizing same that comprises a counterfeit detector capable of communicating with either a local area network or a wide area network by either a external adaptor or a built in network card and port.

It is another object of this invention to provide a counterfeit detection system and method of utilizing same for supporting and improving Currency Scanning Device performances, as well as, efficiently handling banknote counterfeit attempts.

It is another object of this invention to provide a counterfeit detection system and method of utilizing same that uses a new generation of intelligent Currency Scanning Device with an innovative internal firmware and a new advanced communication module as interface, which allow its integration with other systems and resources located on site or remotely.

It is another object of this invention to provide a counterfeit detection system and method of utilizing same that allows two-way communication of specific information and commands.

It is another object of this invention to provide a counterfeit detection system and method of utilizing same that notifies select individuals of the activity or identification of a suspect or counterfeit note.

It is another object of this invention to provide a counterfeit detection system and method of utilizing same that downloads updated software versions and anti-counterfeiting filters to the actual Currency Scanning Devices.

It is another object of this invention to provide a counterfeit detection system and method of utilizing same that collects historical data from the Currency Scanning Devices for use in researching and analyzing counterfeit trends and locations.

It is another object of this invention to provide a counterfeit detection system and method of utilizing same that identifies any service needed or down units.

It is another object of this invention to provide a counterfeit detection system and method of utilizing same that comprise counterfeit detectors with network capability and static IP addresses, and local or wide area networks that connect the Currency Scanning Devices to the Internet.

It is another object of this invention to provide a counterfeit detection system and method of utilizing same that comprises a dedicated web server that collects information from the Currency Scanning Devices and then processes them according to established business rules.

It is yet another object of this invention to provide such a system that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
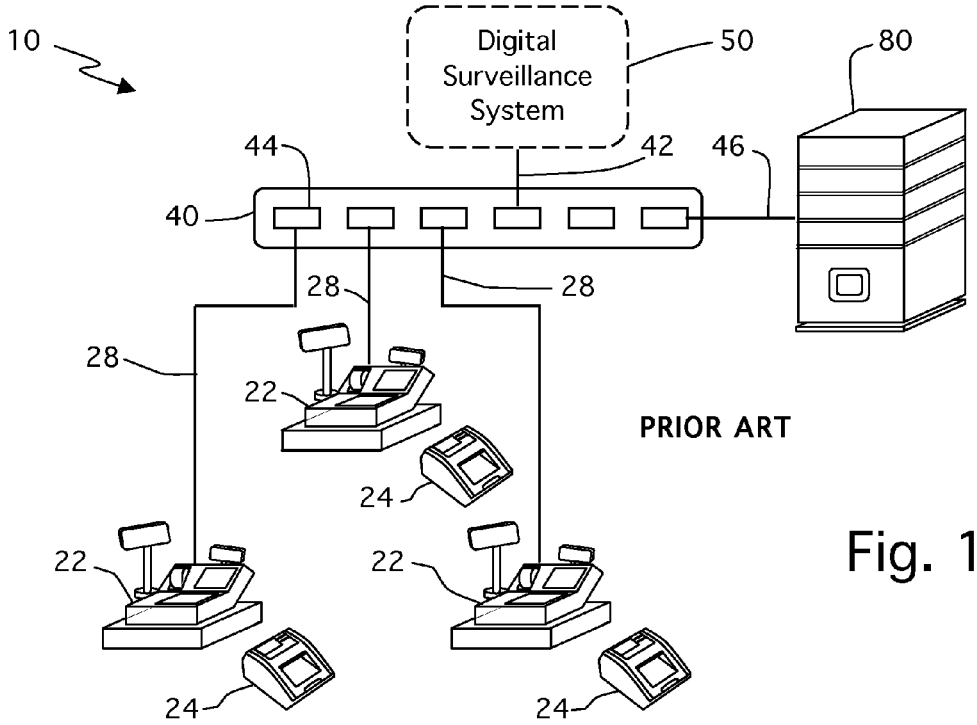
FIG. 1 is a block diagram of a prior art Point of Service and counterfeit detection system.

Referring now to the drawings, the present invention is generally referred to with numeral 100, defining a counterfeit detection system and method of utilizing same. It can be observed that it basically includes Point of Service system 120, hub/switch 140, local server 180, and database 190.

For better comprehension of present invention 100, the following definitions and terms are defined. Currency-Scanning Device is an intelligent counterfeit detector unit, which scans and analyzes a banknote's infrared, magnetic, and ultraviolet characteristics. The infrared, magnetic, and ultraviolet characteristics are compared with standard parameters recorded within the Currency-Scanning Device's memory to determine if the banknote is genuine or not. Currency-Scanning Devices are widely used by retailers when a suspicious banknote is detected.

Currency can be any article or substance used as a medium of exchange, measure of wealth, or means of payment; such as money. It is noted that currency, money, banknotes, and bills may be used interchangeably.

Currency Data are specific infrared, magnetic, and/or ultraviolet security features, which characterize a unique currency denomination. These features are recognized by the Currency-Scanning Devices and are converted into electric signals that are used to analyze the banknote being scanned.

Infrared features are based on special infrared dyes to print some banknote's areas. Typically, dyes are invisible to the naked human eye, but when illuminated with an infrared light, the dyes become visible and the areas printed thereon are easily recognized. There is a specific infrared pattern for each banknote denomination.

Magnetic features are incorporated into banknotes that use dyes, which can be verified by means of magnetic heads. There is a specific magnetic pattern for each banknote denomination.

Ultraviolet features are also incorporated into banknotes whereby they comprise fluorescent dyes that glow under exposure to ultraviolet illumination to make the ultraviolet features easily recognized by the user. There is a specific ultraviolet pattern for each banknote denomination.

Local Server is a server or network of managed servers that store updated software for the Currency-Scanning Devices. From time to time, the Currency-Scanning Devices will access the Local Server requesting a new update. This local server will also create a database, with all suspicious events reported by the Currency-Scanning Devices, with specific characteristics of the fake banknote, as well as the location where it was detected.

Software is a firmware version that is installed in the Currency-Scanning Devices and responds to specific security features of the banknotes being scanned.

Figure 2:
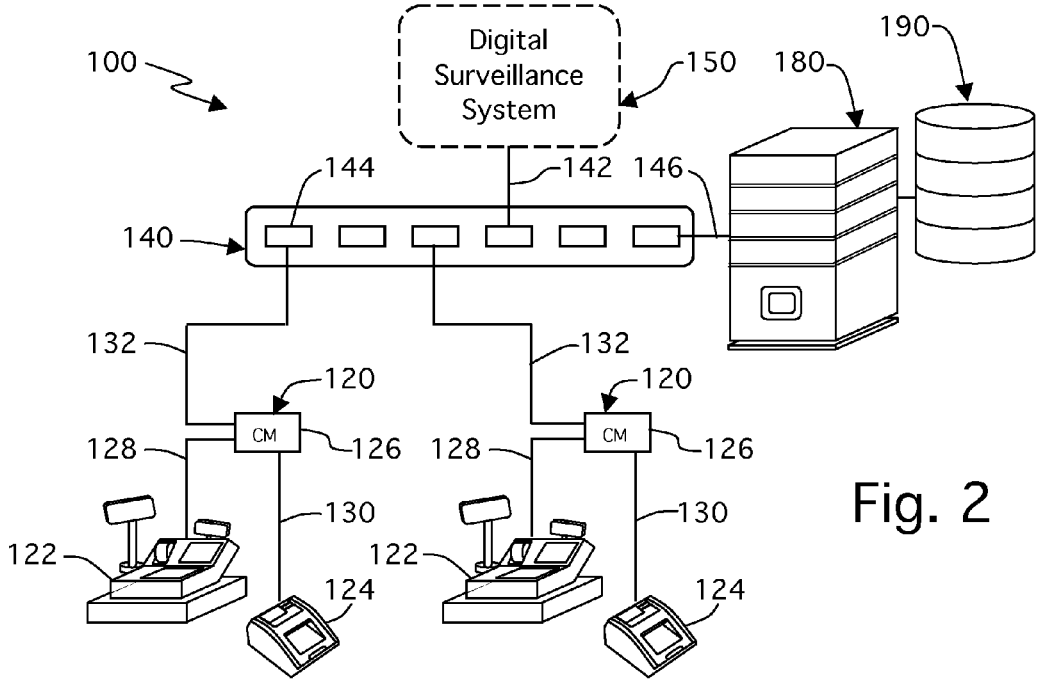
FIG. 2 is a block diagram of a counterfeit detection system at a stand-alone selling facility.

Seen in FIG. 1 is prior art Point of Service system 10. Prior art Point of Service system 10 comprises a high-speed local area network, hereinafter defined as LAN, that connects Point of Service stations 22 with local server 80. More specifically, prior art Point of Service system 10 comprises at least one Point of Service station 22. Connected to Point of Service station 22 is conduit 28 that extends to and connects to port 44 of hub/switch 40. Hub/switch 40 may comprise a plurality of ports 44, of which surveillance system 50 may connect to with conduit 42, and local server 80 may connect to with conduit 46. Surveillance system 50 may be a digital surveillance system. Prior art Point of Service system 10 further comprises at least one Currency-Scanning Device 24 that is typically adjacent to its respective Point of Service station 22. In this configuration, Currency-Scanning Device 24 of prior art Point of Service system 10 therefore works as a stand-alone device, and does not communicate or interact with any other device or system. Seen in FIG. 2 is counterfeit detection system and method of utilizing same 100 at a stand-alone selling facility. Counterfeit detection system and method of utilizing same 100 may also comprise a LAN that connects Point of Service stations, hereinafter defined as Point of Service stations 122 with local server 180. More specifically, counterfeit detection system and method of utilizing same 100 comprises Point of Service system 120 having at least one Point of Service station 122. Connected to Point of Service station 122 is conduit 128 that extends to communication module 126. It is noted that communication module 126 has means to connect to the Internet as defined below. Connected to communication module 126 is conduit 132 that extends to and connects to port 144 of hub/switch 140. Hub/switch 140 may comprise a plurality of ports 144, of which surveillance system 150 may connect to with conduit 142, and local server 180 may connect to with conduit 146. Surveillance system 150 may be a digital surveillance system. Counterfeit detection system and method of utilizing same 100 further comprises Currency-Scanning Device 124 that is adjacent to its respective Point of Service station 122. Connected to Currency-Scanning Device 124 is conduit 130 that extends to communication module 126. Currency-Scanning Device 124 of counterfeit detection system and method of utilizing same 100 is therefore integrated within present invention 100, and does not function as a stand-alone device. In this configuration, communication module 126 is used to interconnect Currency-Scanning Device 124 to other resources present in the stand-alone selling facility, thus allowing Currency-Scanning Device's 124 integration with local resources and local server 180 having database 190.

Communication module 126, as a new electronic device, serves as an interface between Currency-Scanning Device 124 and other resources. Currency-Scanning Device 124 does not interfere with normal functioning of Point of Service station 122. Currency-Scanning Device 124 comprises two RJ-45 jacks where a network cable is connected. Using a pass through link, not seen, Currency-Scanning Device 124 serves as a bridge between hub/switch 140 and Point of Service stations 122. It is noted that in this configuration, communication module 126 is used to interconnect Currency-Scanning Device 124 to other resources present in the stand-alone selling facility.

With regard to hardware features, communication module 126 is an intelligent device comprising an interface for Currency-Scanning Device 124 through serial port (RS232, 9 poles). RS232 is defined as Recommended Standard 232, a standard for serial binary data signals connecting between Data Terminal Equipment and Data Circuit-terminating Equipment; or a USB interface type A plug with other resources present in the selling facility. USB is defined as Universal Serial Bus, which is a serial bus standard to connect devices to a host computer.

Communication module 126 also comprises two RJ-45 jacks that allow it to be connected to conduit 128, that can be a DSL line, of Point of Service stations 122, without interfering communication with other devices connected in the Point of Service station 122. Other devices connected in the Point of Service station 122 include, but are not limited to, a cash register machine, card readers, and barcode readers for example. Communication module 126 also comprises two light-emitting diodes, defined as LED indicators, on a front panel for status notification: i) One red LED will indicate Communication module 126 is powered "on" (solid red); and ii) One green LED (Link LED) indicates that there is an active connection between Communication module 126 and hub/switch 140 (solid green).

Communication module 126 also comprises a DB-9 female connector, which generates an audible alarm signal (high logic level) in one of its pins when a counterfeit bill is detected. This connection will be used to integrate Currency-Scanning Device 124 with surveillance system 150. Surveillance system 150 may be a digital surveillance system. Thus, allowing recording of an event as well as notifying security personnel if desired, and communication module 126 is powered from an external AC-DC type wall adaptor. It is noted however that in the preferred embodiment instant invention 100 does not require surveillance system 150.

Figure 3A:
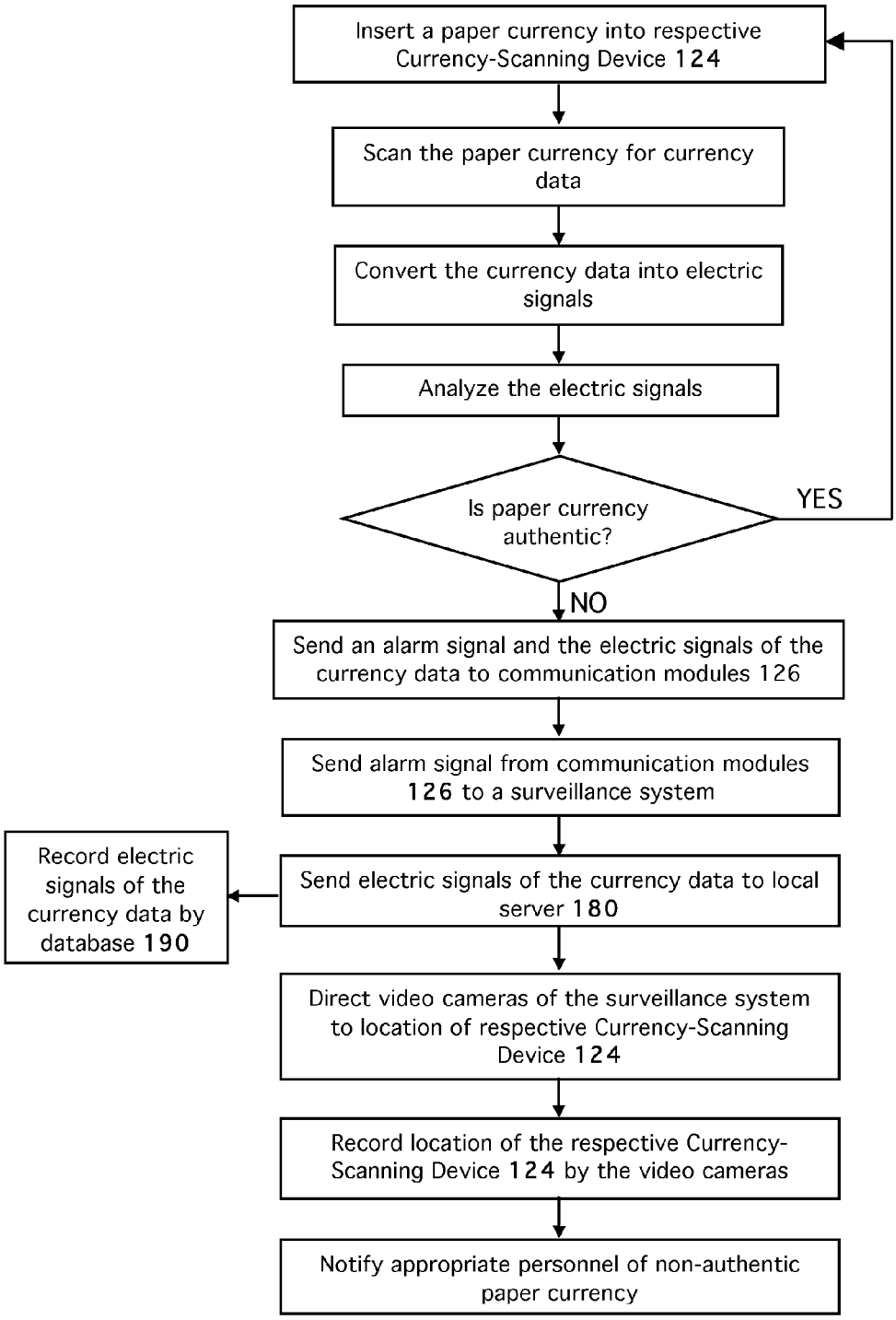
FIG. 3A is a suspicious banknote event flowchart.

As seen in FIG. 3A, instant invention 100 comprises counterfeit detection means to detect counterfeit currency. The counterfeit detection means comprises the steps of:

A) inserting a paper currency into respective Currency-Scanning Device 124;

B) scanning said paper currency for currency data;

C) converting said currency data into electric signals;

D) analyzing said electric signals;

E) recognizing that said paper currency is authentic and proceeding to step A), otherwise proceeding to step F);

F) sending an alarm signal and said electric signals of said currency data to said at least one communication module 126;

G) sending said alarm signal from said at least one communication module 126 to a surveillance system and proceeding to steps H) and J);

H) sending said electric signals of said currency data to said local server 180 having said database 190;

I) recording said electric signals of said currency data by said database 190;

J) directing video cameras of said surveillance system to location of said respective Currency-Scanning Device 124;

K) recording of said location of said respective Currency-Scanning Device 124 by said video cameras; and L) notifying appropriate personnel of said paper currency.

As previously mentioned, instant invention 100 does not require surveillance system 150. In the event that surveillance system 150 is not utilized, Steps G); J); and K) would simply be omitted from the counterfeit detection means defined above.

In the preferred embodiment, the counterfeit detection means comprises each communication module 126 having a unique identification number to identify the location of the fake paper currency and where the fake paper currency was detected. Thus, enabling a record of date, location, and specific currency data obtained by each respective Currency-Scanning Device 124.

The electric signals of the currency data stored in database 190, and the recording of the location of said Currency-Scanning Device 124 by the video cameras assist law-enforcement agencies and the like to address the counterfeiting issue.

Figure 3B:
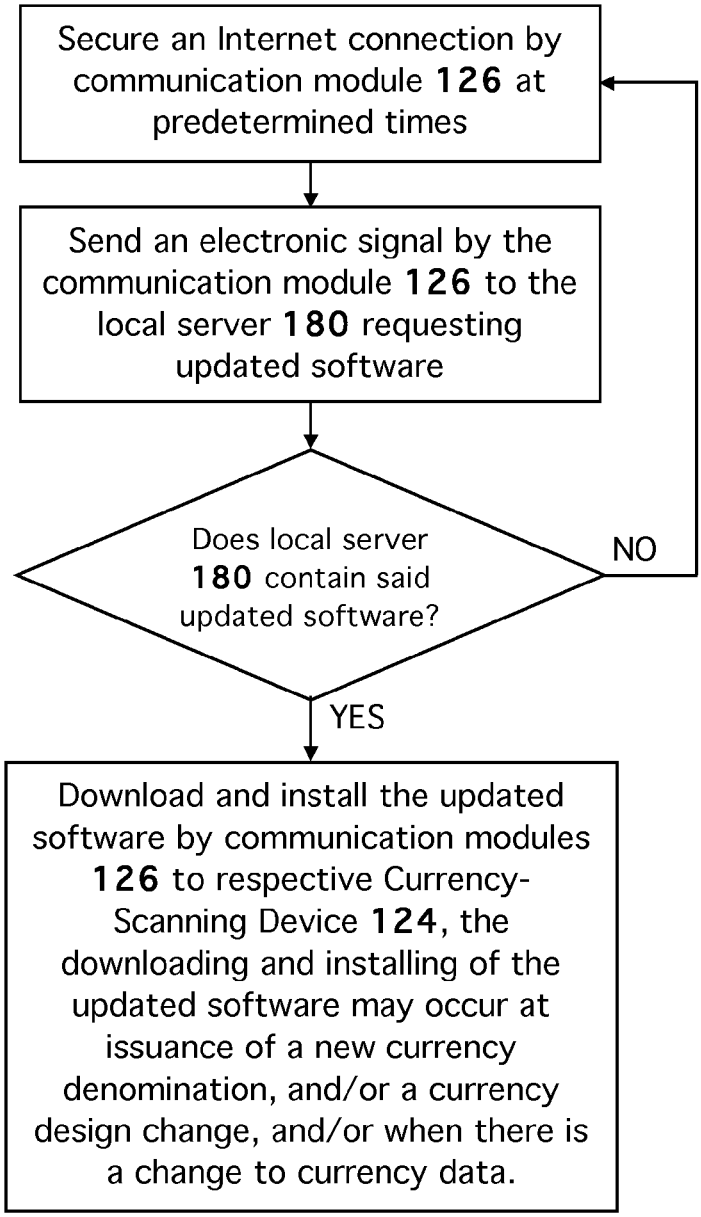
FIG. 3B is an updated software version requesting event flowchart.

As seen in FIG. 3B, instant invention 100 comprises updating means to automatically update software. The software updating means comprises the steps of:

M) securing an Internet connection by said at least one communication module 126 at predetermined times;

N) sending an electronic signal by said at least one communication module 126 to said local server 180 requesting updated software;

O) proceeding to step M) if said local server 180 does not contain said updated software, and proceeding to step P) otherwise; and P) downloading and installing said updated software by said at least one communication module 126 to said respective Currency-Scanning Device 124, said downloading and said installing of said updated software may occur at issuance of a new currency denomination, and/or a currency design change, and/or when there is a change to currency data.

The currency data are specific infrared, magnetic, and/or ultraviolet security features that characterize a unique currency denomination. It is noted that software updates are first updated onto database 190.

Figure 4:
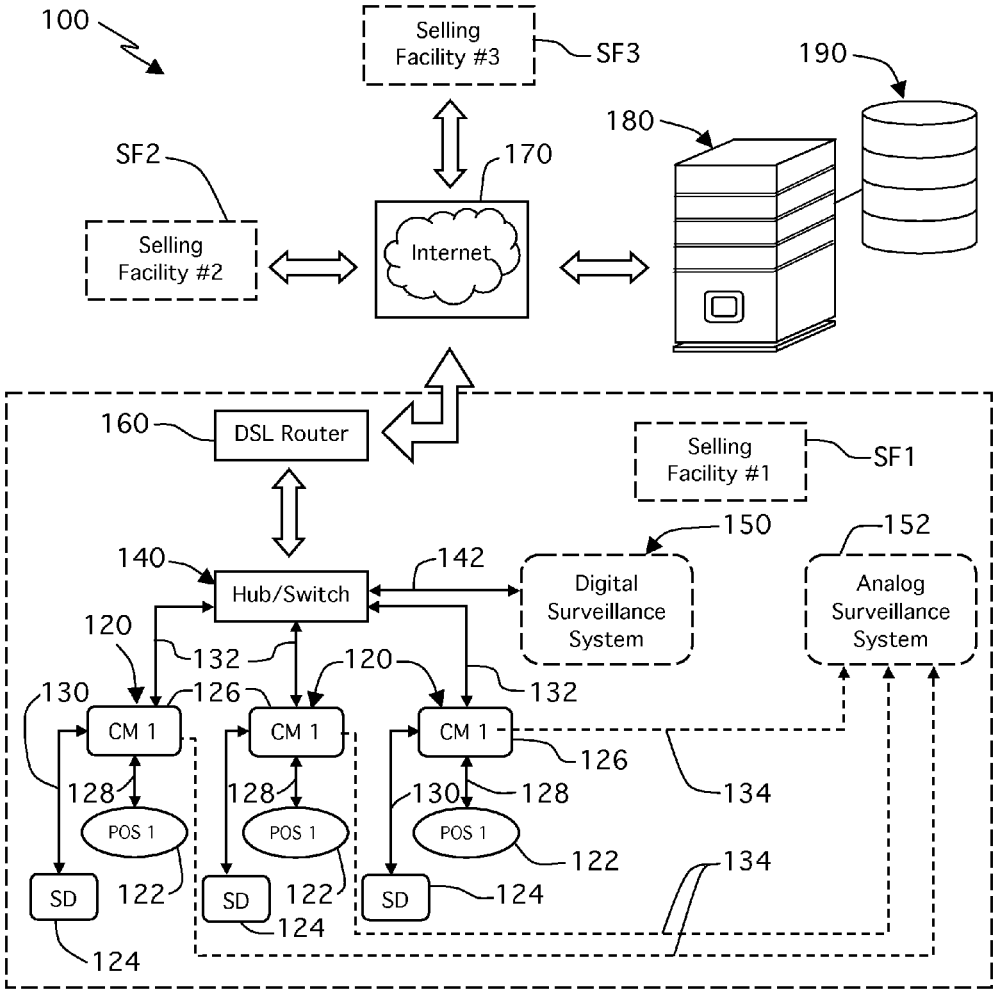
FIG. 4 is a block diagram of the counterfeit detection system at multiple selling facilities.

As illustrated in FIG. 4, present invention 100 is configured to operate at multiple selling facilities SF1, SF2, and SF3. It is noted that for simplicity, only present invention 100 within selling facility SF1 is illustrated since the selling facilities SF2 and SF3 would duplicate that of selling facility SF1.

Each counterfeit detection system and method of utilizing same 100 comprises a LAN or WAN that connects Point of Service stations 122 with local server 180. More specifically, counterfeit detection system and method of utilizing same 100 comprises at least one Point of Service station 122. Connected to Point of Service station 122 is conduit 128 that extends to communication module 126. Connected to communication module 126 is conduit 132 that extends to a port of hub/switch 140. Hub/switch 140 may comprise a plurality of ports, of which surveillance system 150, may connect to with conduit 142. Each communication module 126 may also comprise conduit 134 that connects to surveillance system 152, which may be an analogue surveillance system.

Hub/switch 140 communicates with local server 180 via DSL router 160, and Internet 170 defined as the world-wide-web. Local server 180 comprises database 190. Counterfeit detection system and method of utilizing same 100 further comprises Currency-Scanning Device 124 that is adjacent to its respective Point of Service station 122. Connected to Currency-Scanning Device 124 is conduit 130 that extends to Point of Service system 120 having communication module 126. Currency-Scanning Devices 124 of counterfeit detection system and method of utilizing same 100 are therefore integrated within present invention 100, and do not function as a stand-alone devices. In this configuration, communication modules 126 are used to interconnect Currency-Scanning Devices 124 to other resources present in the selling facility, thus allowing Currency-Scanning Devices 124 integration with the local resources as well as with local server 180.

As described above, present invention 100 is configured to operate within multiple selling facilities SF1, SF2, and SF3. This is possible with each selling facility's respective DSL router, and Internet 170 through the Internet.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A counterfeit detection system and method of utilizing same, comprising:

A) a Point of Service system having at least one Point of Service station and a respective Currency-Scanning Device, and at least one communication module having means to connect to Internet;

B) a hub or switch;

C) a surveillance system;

D) a local server;

E) a database; and

F) counterfeit detection means comprising the steps of:

G) inserting a paper currency into said respective Currency-Scanning Device;

H) scanning said paper currency for currency data;

I) converting said currency data into electric signals;

J) analyzing said electric signals;

K) recognizing that said paper currency is authentic and proceeding to step G), otherwise proceeding to step L);

L) sending an alarm signal and said electric signals of said currency data to said at least one communication module;

M) sending said alarm signal from said at least one communication module to a surveillance system and proceeding to steps N) and P);

N) sending said electric signals of said currency data to said local server having said database;

O) recording said electric signals of said currency data by said database;

P) directing video cameras of said surveillance system to location of said respective Currency-Scanning Device;

Q) recording of said location of said respective Currency-Scanning Device by said video cameras; and R) notifying appropriate personnel of said paper currency;

further characterized in that said at least one Point of Service station is connected to a cash register machine, card readers, or barcode readers, said at least one communication module also comprises two light-emitting diodes on a front panel for status notification, one of said two light-emitting diodes is red to indicate said at least one communication module is powered on, and a second of said two light-emitting diodes is green to indicate an active connection between said at least one communication module and said hub or switch, said at least one communication module also comprises a DB-9 female connector, which generates an audible alarm signal in one of its pins when a counterfeit bill is detected, said DB-9 female connector integrates said respective Currency-Scanning Device with said surveillance system, thus allowing recording of an event as well as notifying security personnel if desired, said at least one communication module has a unique identification number to identify a location of a fake paper currency and where said fake paper currency was detected, thus enabling a record of date, location, and specific currency data obtained by each said respective Currency-Scanning Device, and further comprising at least one DLS router having access through said Internet to enable said hub or switch to send information to said local server when configured to operate at multiple selling facilities.

2. The counterfeit detection system and method of utilizing same set forth in claim 1, further comprising software updating means comprising the steps of:

S) securing an Internet connection by said at least one communication module at predetermined times;

T) sending an electronic signal by said at least one communication module to said local server requesting updated software;

U) proceeding to step S) if said local server does not contain said updated software, and proceeding to step V) otherwise; and V) downloading and installing said updated software by said at least one communication module to said respective Currency-Scanning Device, said downloading and said installing of said updated software may occur at issuance of a new currency denomination, or a currency design change, or when there is a change to currency data.

3. The counterfeit detection system and method of utilizing same set forth in claim 2, further characterized in that said currency data includes specific infrared, magnetic, or ultraviolet security features that characterize a unique said new currency denomination.

4. The counterfeit detection system and method of utilizing same set forth in claim 1, further characterized in that said at least one communication module serves as an interface for said respective Currency-Scanning Device.

5. The counterfeit detection system and method of utilizing same set forth in claim 1, further characterized in that said respective Currency-Scanning Device comprises two RJ-45 jacks where a network cable is connected, using a pass through link, said respective Currency-Scanning Device serves as a bridge between said hub or switch and said at least one Point of Service station, and said at least one communication module is used to interconnect said respective Currency-Scanning Device in a stand-alone selling facility, said at least one communication module is an intelligent device comprising an interface for said respective Currency-Scanning Device through a RS232 serial port having nine poles, said RS232 serial port is defined as Recommended Standard 232 for serial binary data signals connecting between Data Terminal Equipment and Data Circuit-terminating Equipment or a USB interface type A plug defined as Universal Serial Bus, which is a serial bus standard to connect devices to a host computer, said at least one communication module also comprises two RJ-45 jacks that allow it to be connected to a DSL line of said at least one Point of Service station.

* * * * *